US006702269B1

(12) United States Patent
Tadich

(10) Patent No.: US 6,702,269 B1
(45) Date of Patent: Mar. 9, 2004

(54) TRUSS JIGGING SYSTEM

(75) Inventor: John Tadich, Knoxfield (AU)

(73) Assignee: MiTek Holdings, Wilmington, DE (US)

( * ) Notice: Subject to any disclaimer, the term of this patent is extended or adjusted under 35 U.S.C. 154(b) by 0 days.

(21) Appl. No.: 10/030,459

(22) PCT Filed: Mar. 28, 2000

(86) PCT No.: PCT/US00/08153

§ 371 (c)(1),
(2), (4) Date: Jun. 5, 2002

(87) PCT Pub. No.: WO00/59695

PCT Pub. Date: Oct. 12, 2000

(30) Foreign Application Priority Data

Apr. 1, 1999 (AU) ..... PP 9568
Apr. 13, 1999 (AU) ..... PP 9730

(51) Int. Cl.[7] ..... B25B 1/20

(52) U.S. Cl. ..... 269/37; 269/910; 269/305; 269/304; 29/281.1

(58) Field of Search ..... 269/37, 910, 268, 269/303, 305, 99, 271; 29/281.3, 281.1, 559; 100/913, 295, 100; 227/152, 154–155

(56) References Cited

U.S. PATENT DOCUMENTS 1,649,226 A 11/1927 Gstalder
1,685,729 A 9/1928 Stone
1,755,031 A 4/1930 Schmuckler
1,867,449 A 7/1932 Ecket et al.
2,212,421 A 8/1940 Henderson
2,442,726 A 6/1948 Gstalder
2,810,414 A 10/1957 Wilson
2,815,074 A 12/1957 Dehn
2,870,531 A 1/1959 Hudson
2,919,733 A 1/1960 Johnson
2,964,807 A 12/1960 Kennedy
2,983,292 A 5/1961 McKinley
3,068,484 A 12/1962 Moehlenpath et al.
3,241,585 A 3/1966 Jureit (List continued on next page.)

OTHER PUBLICATIONS

PCT International Search Report, Aug. 22, 2001.
Gang–Nail Systems, Inc., The Gang–Nail Easy Set System Manual, entitled Gang–Nail Easy Set Hardware, 19 pages (admitted prior art), date unknown.
HIB–91 Summary Sheet, Truss Plate Institute, Frames 1–6 (admitted prior art), date unknown.
MiTek Industries, Inc., Mitek Easy–Set Jigging System Brochure, 1993.
USP Kant–Sag, Silver, Lumber Connectors, Plated Truss, 1996, p. 88.

*Primary Examiner*—Lee D Wilson
(74) *Attorney, Agent, or Firm*—Senniger, Powers, Leavitt & Roedel

(57) ABSTRACT

A truss jigging system has tools moveable in a channel to different locations on an assembly table and which can be readily interchanged. The tools are capable of snap locking engagement with a carriage mounted in the table channels. A resilient component support on the carriage supports components of the truss in a position above the top of the assembly table. The component support deforms when a downward force is applied by a press for driving connector plates into the components so that the component engages the table. A heel locating device of the jigging system can be secured to the table and extended or retracted as needed to precisely locate the truss heel.

26 Claims, 13 Drawing Sheets

U.S. PATENT DOCUMENTS 3,298,151 A 1/1967 Jureit
3,299,920 A 1/1967 Koenigshof
3,421,751 A 1/1969 Menge
3,552,254 A 1/1971 Marczy
3,667,379 A 6/1972 Templin
3,866,530 A 2/1975 Moehlenpah
3,873,221 A 3/1975 Greenfield
3,959,945 A 6/1976 Allen
4,040,232 A 8/1977 Snow et al.
4,084,498 A 4/1978 Weaver
4,122,647 A 10/1978 Kovar
4,154,436 A 5/1979 Sellers
4,241,557 A 12/1980 Jensen
4,246,736 A 1/1981 Kovar et al.
4,286,778 A 9/1981 Follmeyer
4,308,703 A 1/1982 Knowles
4,322,064 A 3/1982 Jarvis
4,361,999 A 12/1982 Sidney
4,379,426 A 4/1983 Thompson et al.
4,453,705 A 6/1984 McDonald
4,455,805 A 6/1984 Rionda et al.
4,514,901 A 5/1985 Kirby
4,561,230 A 12/1985 Rionda et al.
4,567,821 A 2/1986 McDonald
4,604,845 A 8/1986 Brinker
4,627,564 A 12/1986 Bowser
4,637,195 A 1/1987 Davis
4,650,106 A 3/1987 Branaman
4,669,184 A 6/1987 Castillo
4,669,235 A 6/1987 Reinen
4,704,829 A 11/1987 Baumker, Jr.
D293,416 S 12/1987 Krueger
4,711,437 A 12/1987 Longnecker et al.
4,819,475 A 4/1989 Irvello
4,821,408 A 4/1989 Speller et al.
4,875,666 A * 10/1989 Hain ..... 269/37
4,897,979 A 2/1990 Colonias
4,943,038 A 7/1990 Harnden
4,964,253 A 10/1990 Loeffler
4,995,146 A 2/1991 Woods
4,998,336 A 3/1991 Papsdorf
D318,785 S 8/1991 Dean
5,058,352 A 10/1991 Loiselle et al.
5,085,414 A 2/1992 Weaver
5,092,028 A 3/1992 Harnden
5,211,108 A 5/1993 Gore et al.
5,342,030 A 8/1994 Taylor
5,361,495 A 11/1994 Pyle et al.
5,364,312 A 11/1994 Cunard et al.
5,385,339 A 1/1995 Williams
5,388,318 A 2/1995 Petta
5,412,920 A 5/1995 Hess
5,423,156 A 6/1995 Nellessen, Jr.
5,606,837 A 3/1997 Holizlander
5,608,970 A * 3/1997 Owen ..... 29/897.31
5,617,622 A 4/1997 Anderson
5,676,358 A 10/1997 Shamblin et al.
5,702,095 A 12/1997 Williams
5,810,341 A 9/1998 Williams
5,854,747 A 12/1998 Fairlie
5,884,448 A 3/1999 Pellock
5,941,514 A 8/1999 Burcaw
6,267,365 B1 * 7/2001 Anglin et al. ..... 269/37

* cited by examiner

TRUSS JIGGING SYSTEM

BACKGROUND OF THE INVENTION

This invention relates generally to a jigging system for work pieces and, in particular, to a jigging system for the assembly of wooden trusses for use in building.

The invention relates to an improvement to that disclosed in our Australian Patent No. 694642 (U.S. Pat. No. 5,854,747), the contents of which are incorporated into this specification by this reference.

Wooden trusses generally comprise a number of wooden components including a bottom chord, upper chords which are generally arranged in a V-shaped configuration, and connecting pieces or webs between the chords. The chords and connecting webs are joined together by metal connector plates which are usually forced into the wooden components at joints between components on both sides of the truss by a suitable press or the like. Conventionally, the components from which the truss are to be made are laid out on a table which has stops (often referred to as pucks) for setting the position of the chords.

The above-mentioned Australian patent discloses an automatic method of moving the stops or pucks to desired locations to set the position of the chords which are to be joined together to form the truss. The formation of the truss from the chords also requires the placement of various tools such as a peak or apex tool and clamp tools in order to define the position of the peak or apex and hold the two chords, which will be joined together to form the apex, in position. Heel tools are also required in order to define the points at which the upper chords will intersect with the bottom chord. The location of these tools is performed manually by locating the tools in position on the table before or after the stops have been automatically moved to define the position of the chords.

The need to manually locate the tools increases the time required in order to set up the jigging system for formation of a truss and therefore the time required in order to actually produce a truss.

BRIEF DESCRIPTION OF THE DRAWINGS

A preferred embodiment of the invention will be described, by way of example, with reference to the accompanying drawings, in which.

DETAILED DESCRIPTION OF THE PREFERRED EMBODIMENT

Figure 1:
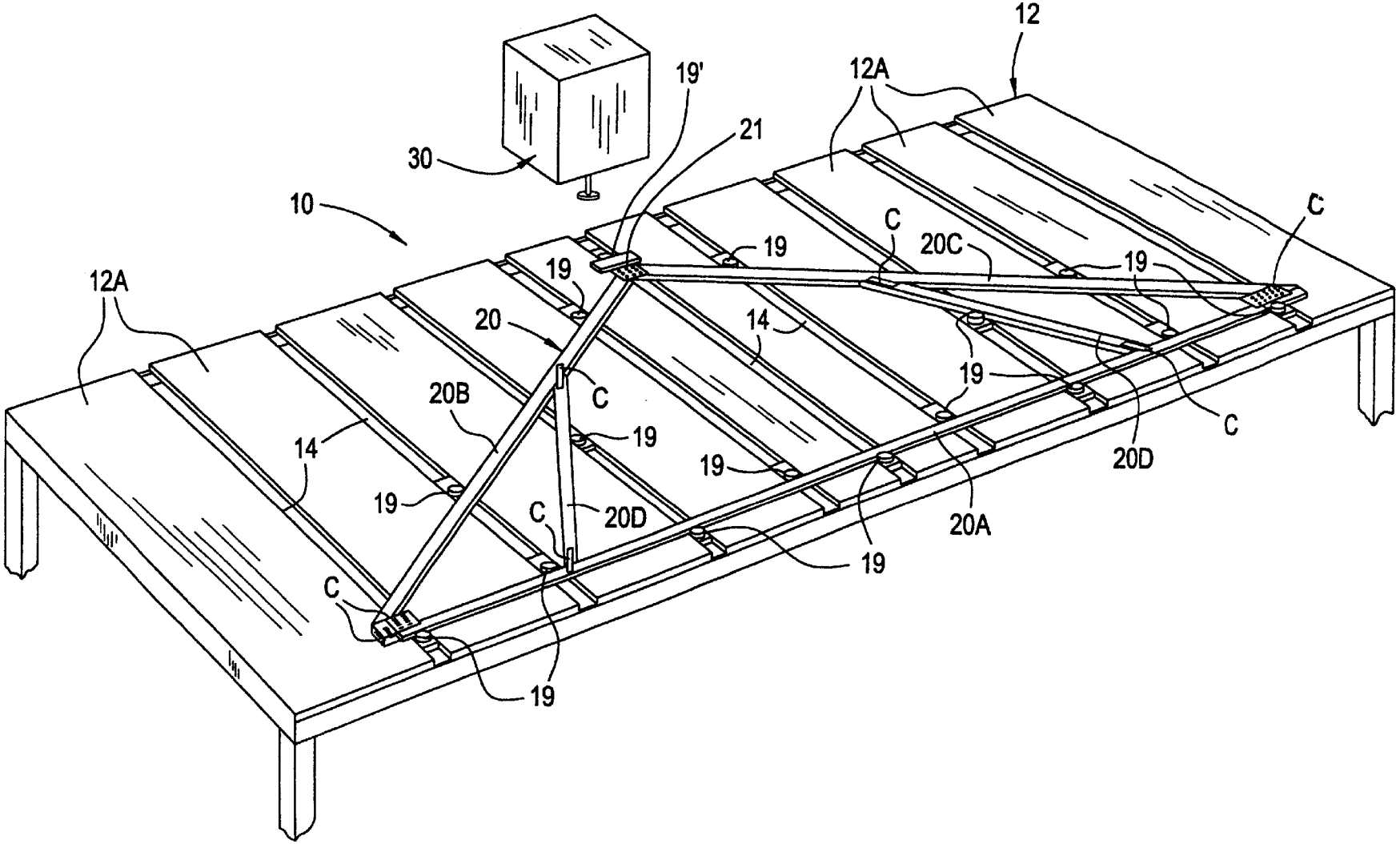
FIG. 1 is a perspective view of a jigging system according to the preferred embodiment of the invention.

With reference to the drawings, an assembly table 10 is shown. Tables of this type may typically be up to 30 meters (100 feet) in length and 4.2 meters (15 feet) in width. The table 10 has an upper platform generally indicated at 12, formed from solid sheets 12A or sections or the like which are spaced apart to define a plurality of slots 14 which, in the embodiment of FIG. 1, extend across the width of the table. Rather than extend across the width of the table as shown in FIG. 1, the slots 14 could also extend lengthwise or at an angle across the table if desired. The upper platform 12 constitutes a reaction surface in the preferred embodiment.

Arranged for movement along the slots 14 in a manner to be described hereinafter are a plurality of stops or pucks 19. Typically, the shape of a truss 20 is known and its details are fed into a control system 30, which controls movement of the pucks 19. The pucks 19 are then moved in a manner which will be described hereinafter to positions needed to locate the truss components for forming the truss 20. In the preferred embodiment of this invention, some of the slots 14, rather than being provided with pucks 19 are provided with other jigging tools. Such jigging tools may include apex tools 19' and clamp tools 19", described hereinafter. It is to be understood that "tools" as used herein includes the pucks 19, as well as apex tools 19', clamp tools 19" or other suitable jigging tools. Such tools are necessarily arranged on the table 10 to define a jig for assembling the truss. Chords 20A, 20B and 20C from which the truss is to be formed are laid out together with webs 20D, with the chords abutting the pucks 19. Connector plates C are located in generally opposed relation on top and bottom of the truss 20 at the joints of the chords 20A, 20B and 20C and the webs 20D, and the connector plates are driven into the truss 20 in a suitable manner such as by presses or the like (not shown) to form the truss 20. The truss 20 is removed from the table 10 and new components, such as new chords which are the same as those referred to above, are located in place to form a new truss. If the shape of the new truss is different, the jig tools 19, 19', 19" are first moved under the control of a control system 30 (FIG. 10) to new positions for locating truss components of the new truss.

Figure 2:
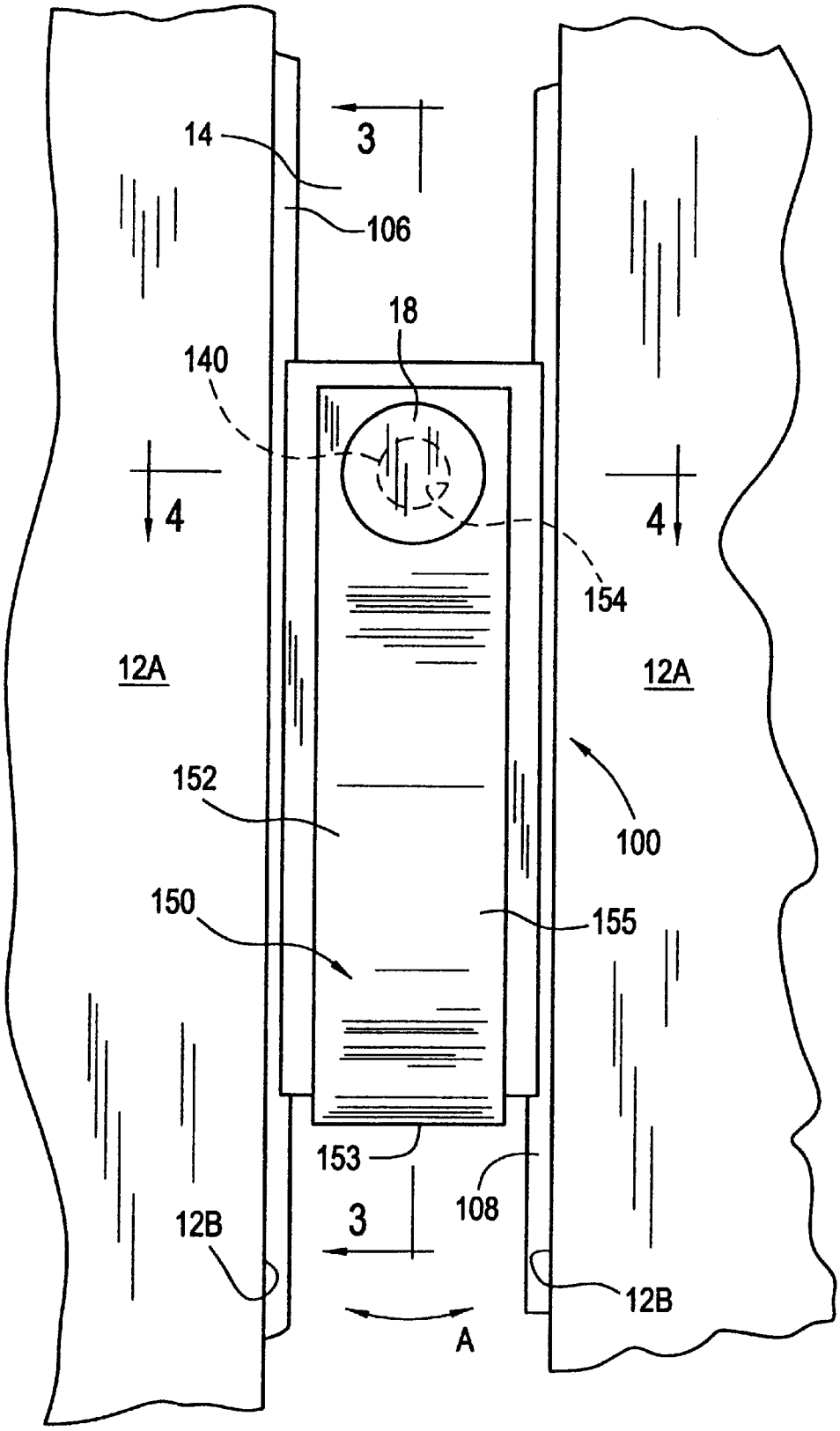
FIG. 2 is a greatly enlarged, fragmentary top plan view of the table showing a puck, but with the truss shown in FIG. 1 removed for clarity.
Figure 3:
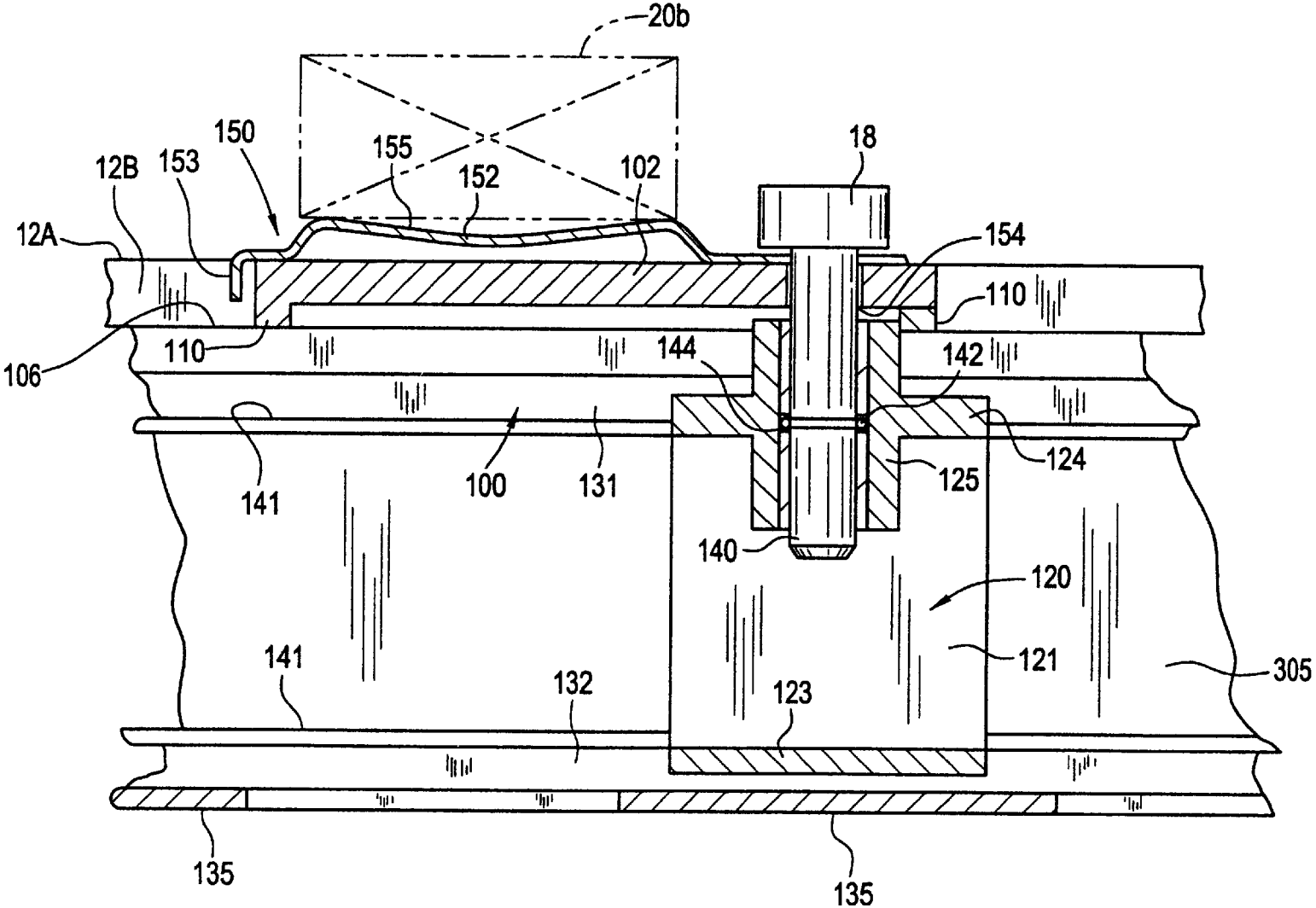
FIG. 3 is a section taken in the plane including line 3—3 of FIG. 2.
Figure 4:
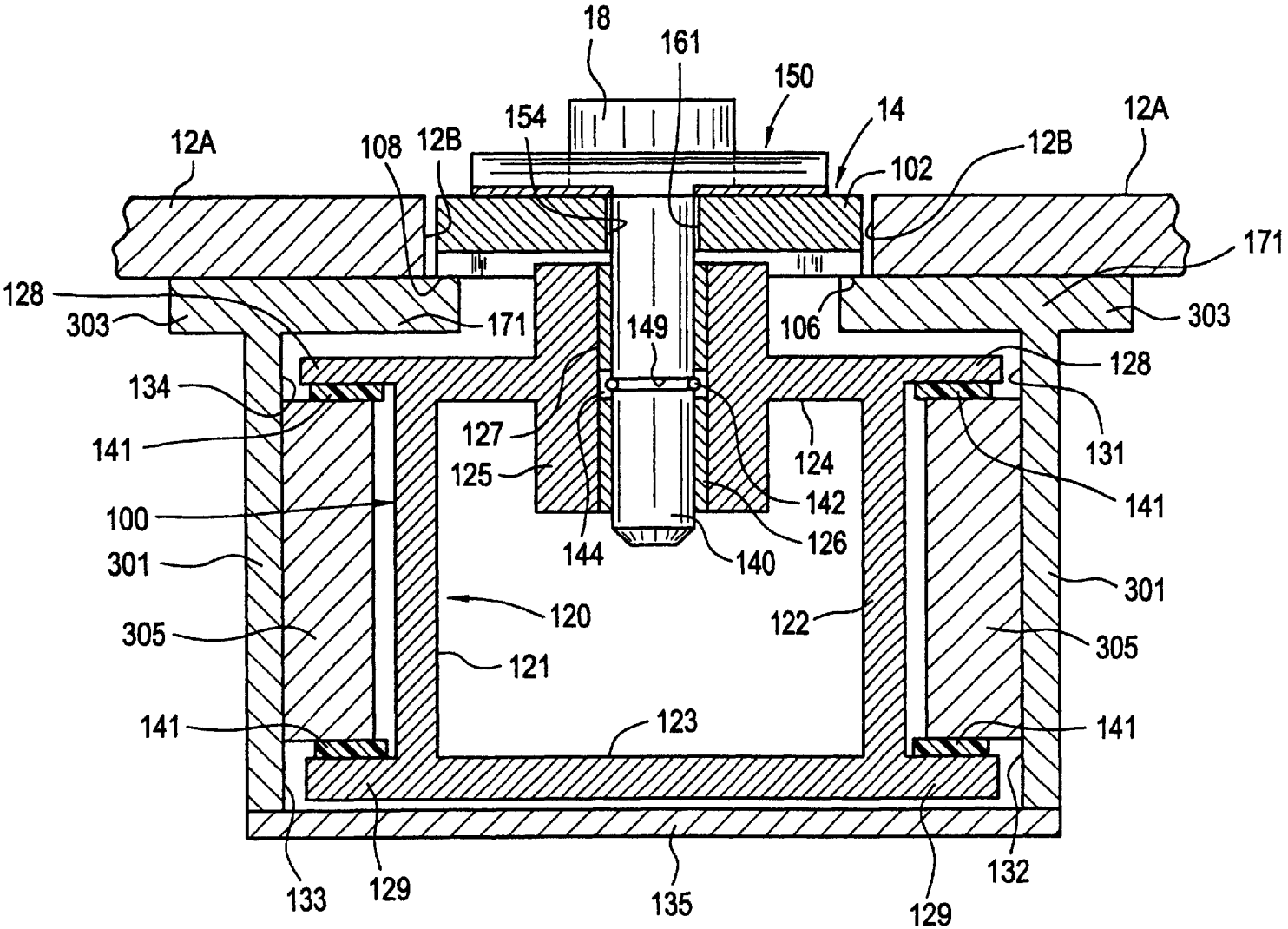
FIG. 4 is a section taken in the plane including line 4—4 of FIG. 2.

FIGS. 2 to 4 are detailed views showing two adjacent table sections 12A separated by one of the slots 14. A carriage 100 is arranged within the slot 14 and is moved by a motor M and flexible endless belt 52 (FIG. 10A). The details of the motor M and belt 52 are fully disclosed in our previously mentioned Australian patent, and will only be briefly described hereinafter. Suffice it to say that the carriage 100 is secured to the flexible belt 52 described in the above mentioned patent for movement along the slots 14 as the belt is driven back and forth by the motor M. There are preferably two carriages per slot 14.

The carriage 100 has a top plate 102 which is supported on steps 106 and 108 of a guide rail 130 by blocks 110 which are attached by welding or the like to the top plate 102. The top plate 102 supports a puck 19. Alternatively, the carriage 100 can carry another tool such as an apex tool 19' (FIG. 5) for defining the apex of the truss to be formed or a clamp tool 19" (FIG. 7). The apex tool 19' and clamp tool 19" will be described in more detail with reference to FIGS. 5 to 7.

Referring again to FIGS. 3 and 4, the carriage 100 further includes a carriage guide 120 located below the top plate 102. The carriage guide is guided in the guide rail 130, in which are defined four channels 131, 132, 133 and 134. The rail 130 is supported by a frame (not shown) beneath the table sections 12A and has inwardly projecting flange portions 171 which define the steps 106 and 108 with the sections 12A. The carriage guide 120 is of generally box construction having side walls 121 and 122, top wall 124 and bottom wall 123. The top wall 124 has extending flanges 128 and the bottom wall 123 has extending flanges 129. The flanges 128 and 129 ride in the channels 131 to 134 on plastic strips 141 to facilitate sliding movement of the carriage 100 along the rail 130. The carriage guide 120 is secured to the flexible belt 52 (see FIG. 10A) which is driven by the motor M and drive rollers 46, 46' (as disclosed in our previously mentioned Australian patent) so that the carriage 100 is driven along the guide rail 130.

The top wall 124 of the carriage guide 120 carries a cylindrical sleeve 125 having an internal annular upper bushing 127 and an internal annular lower bushing 126 which have a space 144 between them. The puck 19 is provided with a pin 140 which projects downwardly from the underside of the puck. The pin 140 has a circumferential groove 149 in which is located a split ring retainer or circlip 142 (broadly, "resilient locking member") when the puck 19 is connected to the carriage 100. Top plate 102 is provided with a hole 161 and the pin 140 passes through the hole and into the sleeve 125 which is aligned with the hole.

As the pin 140 moves downward past the upper bushing 127 an into the space 144, the pin engages the inner diameter of the circlip 142. The leading end of the pin 140 is tapered, but the main portion of the pin has a diameter larger than the inner diameter of the circlip 142 so that the circlip is resiliently deflected outward from its relaxed position. When the groove 149 of the pin reaches the space 144, the circlip 142 snaps into the groove, attaching the pin 140 to the carriage. Further movement of the pin 140 axially of the sleeve 125 is resisted by engagement of the circlip 142 with the upper or lower bushings 127, 126 at the boundaries of the space 144. Thus, the pin 100 snaps into a releasable locking engagement with the carriage 100 upon insertion into the sleeve 125. The pin 140 also couples the top plate 102 to the carriage guide 120. Thus, when the carriage guide 120 is moved by the flexible belt 52 along the slot 14, the top plate 102 and puck 19 are moved conjointly with it. As will be apparent from FIGS. 2, 3 and 4, the top plate 102 slides on shoulders 106 and 108 via blocks 110 as carriage guide 120 and top plate 102 move.

A resilient truss component support 150 connected by the pin 140 to the carriage 100 holds a chord (such as the chord 20B shown in FIG. 3) above a top surface of the upper platform 12 of the table 10. The support 150 comprises a metal spring plate 152 which has a hole 154 through which the pin 140 passes to that the plate 152 is secured to the carriage 100 on the top plate 102 by the pin 140. The spring plate 152 extends substantially the length of the top plate 102 and rests at its ends on the top plate 102. A raised central ("second") portion 155 is higher than the level of the table sections 12A. Many or all of the carriages 100 carrying a puck 19 have the support 150 so that the supports collectively hold the chords 20A–20C and webs 20D off the upper platform 12. Thus, the truss chords 20A–20C are supported above the level of the assembly table sections 12A so that tooth connector plates C can be positioned on the sections 12A beneath the chords 20A–20C. The left heel of the truss 20 is broken away in FIG. 1 to reveal a connector plate C located on the bottom side of the truss. Bottom side connector plates (not shown) are similarly located at the other joints of the truss 20.

The support plate 152 is formed from a resilient spring metal and has an end flange 153 which extends over the end of top plate 102 and into slot 14 so that the spring plate 152 cannot be inadvertently rotated relative to the top plate 102, and the spring plate 152 can be maintained in the operative position shown in FIGS. 2, 3 and 4 for supporting a chord 20B. Any tendency for the plate 152 to rotate in the directions indicated by double headed arrow A in FIG. 2 will be prevented by the sides of the flange 153 contacting side walls 12B of the sections 12A.

The spring metal plate 152 holds the chords 20A–20C in a position slightly above the top of the upper platform 12. Thus, connector plates can be slid, teeth up, under the chords 20A–20C and webs 20D at joint locations, or put in these locations prior to placement of the chords and webs on the upper platform 12. Connector plates are also placed on top of the chords and webs at the joints. To attach the connector plates to the chords 20A–20C and webs 20D, a suitable press (not shown) applies a downward force to the chords, webs and connector plates. The force of the press overcomes the spring force of the metal spring plates 152, deflecting the central portion 155 and pushing it down so that the top surface of the sections 12A of the upper platform 12 can provide a rigid reaction surface opposing the action of the press. The teeth of the connector plates are driven by the press into chords 20A–20C and webs 20D as a result of the reaction force provided by the upper platform 12. The spring plates 152 resume their prior configuration as soon as the press force is released. In this way, the carriage 100 is protected from experiencing the high loads from the press while permitting placement of connector plates under the chords and webs.

Figure 5:
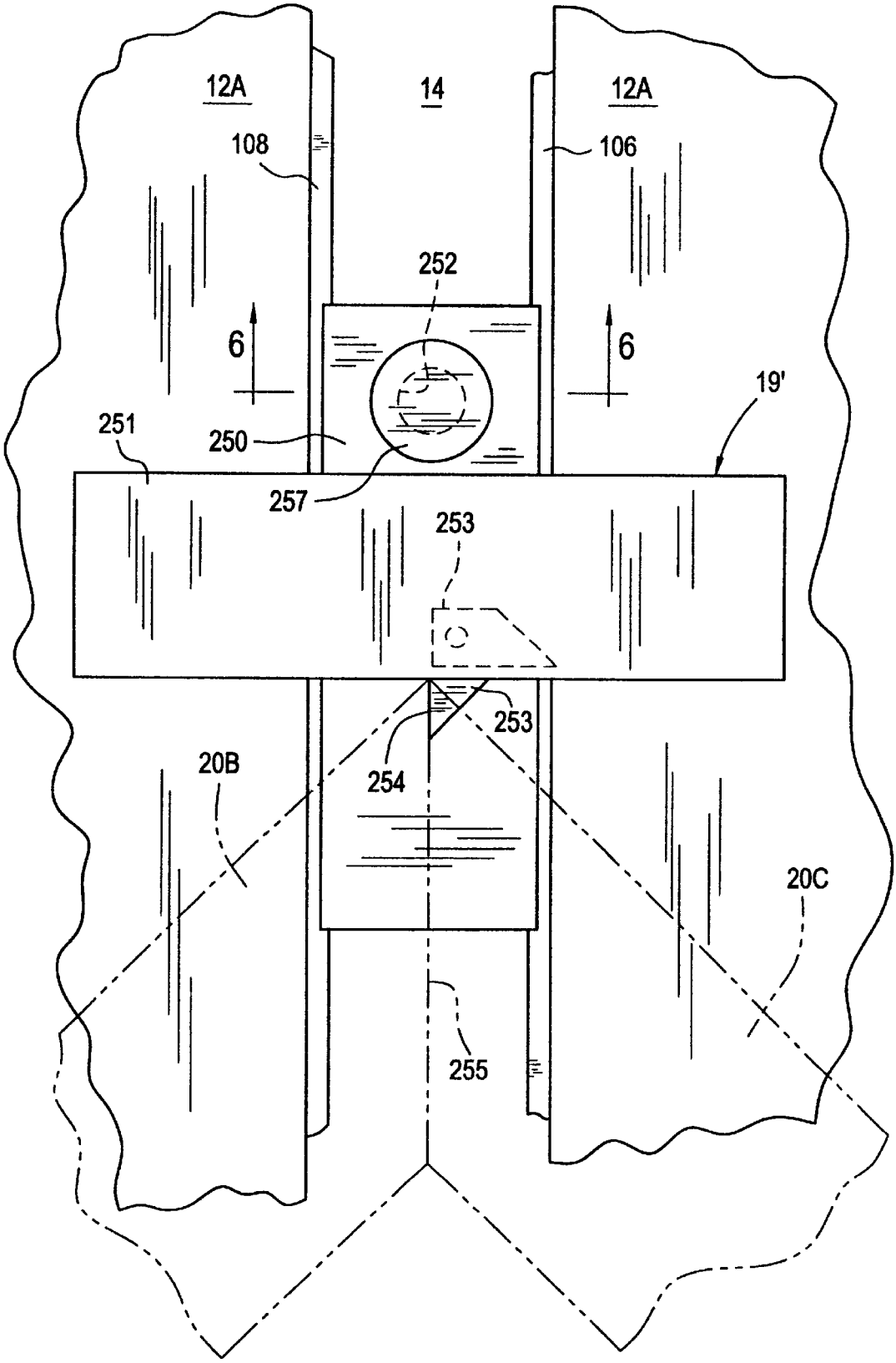
FIG. 5 is a fragmentary plan view similar to FIG. 2, but showing an apex tool.

FIG. 5 shows a plan view similar to FIG. 2 except that an apex tool 19' for positively locating the apex of truss 20 is shown. The apex tool 19' has a base plate 250 (closely similar to top plate 102) which is provided with a hole 252. The base plate 250 has a block 110' (FIG. 6) at each end which ride on steps 106 and 108 of the guide rail 130 in the same manner as the blocks 110 attached to the top plate 102 of the carriage 100 described with reference to FIG. 4. An apex tool cross-member 251 is attached as by welding to the base plate 250 so the base plate (with the blocks 110') and cross-member are a single unit. The cross-member 251 carries a retractable locating finger 253 which has a side edge 254. The side edge 254 positions an angled end 255 of chord 20B of the truss 20 (shown in phantom) so that the chord can be correctly located in place at the apex of the truss. The apex tool 19' is moved to the desired position by carriage 100 (as describe above for puck 19) so as to locate the locating finger 253 and therefore the edge 254 in the required position. When the chord 20B is positioned, the locating finger 253 can be withdrawn (as indicated in hidden lines in FIG. 5) so that the other upper chord 20C can abut against the end of the chord 20B to thereby position the chord 20C. The structure and mode of operation of the member 251 is conventional and therefore the apex tool 19' will not be shown or described in any further detail.

Figure 6:
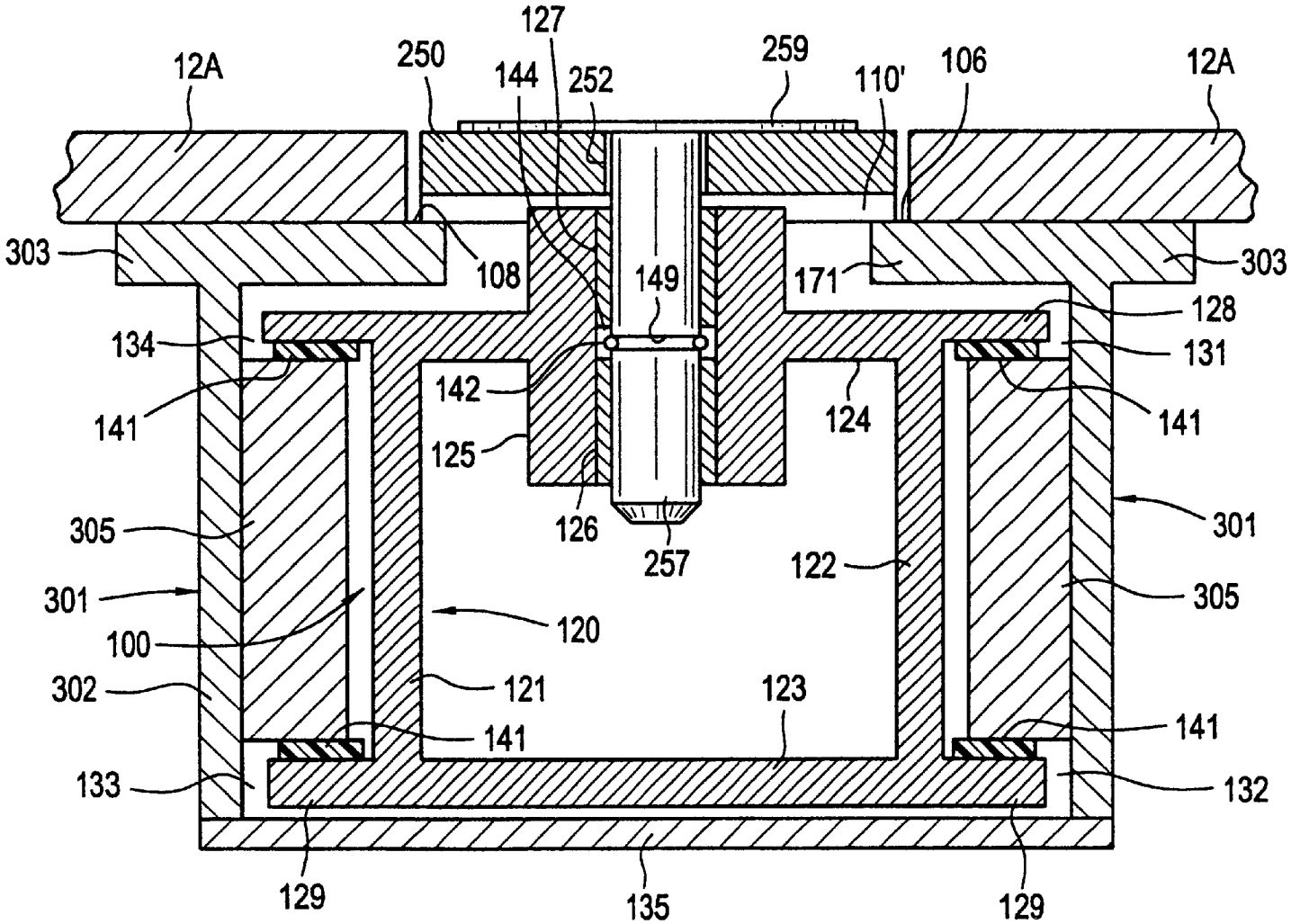
FIG. 6 is section taken in the plane including line 6—6 of FIG. 5.
Figure 7:
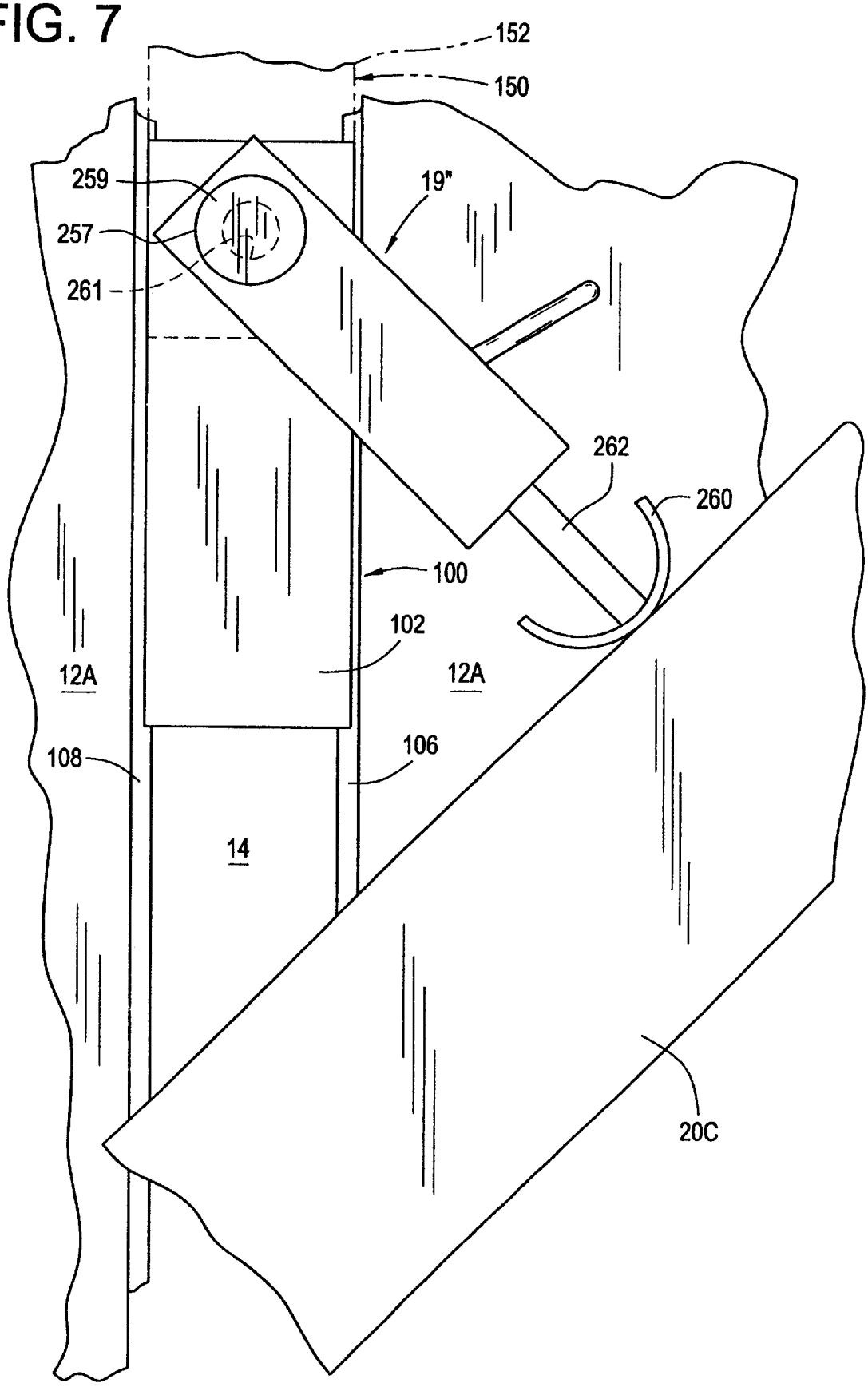
FIG. 7 is a plan view showing a clamp tool.

As best shown in FIG. 6, the blocks 110' of the apex tool 19' ride on the steps 106 and 108 which are formed at the ends of the portions 171 of the guide rail 130. In this embodiment, the upper plate 102 (with its attached blocks 110) of the carriage 100 is removed by simply removing the pin 140 which attaches the top plate 102 to the carriage guide 120 and lifting the top plate 102 out of the slot 14. The base plate 250 is then placed in the slot 14 on the steps 106 and 108 and the hole 251 aligned with sleeve 125 of the carriage guide 120. A pin 257 is then pushed through the aligned hole 251 and the sleeve 125 so that the pin 257 secures the apex tool 19' to the carriage guide 120 in exactly the same manner as the pin 140 secures the puck 19 to the carriage guide 120 described with reference to FIG. 4. In FIG. 5, a pin 140 can be provided by one of the pucks 19 previously described. However, in the embodiment shown the pin 257 is a separate pin which is similar to the pin 140 except that the head 259 is substantially flat since the pin 257 need not form the function of the puck 19.

FIG. 7 shows an embodiment in which a clamp tool 19" is automatically moved by the carriage 100. In this embodiment, the top plate 102 is located in position in the same manner as described with reference to FIGS. 3 and 4. The clamp tool 19" is secured to the top plate 102 by the same type of pin 257 described with reference to FIGS. 5 and 6 and which passes through a hole 261 formed in the clamp tool 19". However, once again, a puck 19 having the pin 140 could be used instead of the pin 257. The clamp tool 19" is pivotal about the pin 257 to arrange the tool at right angles with respect to a chord 20C so that a clamp head 260 can engage the chord 20C to push the chords 20A–20C and webs 20D together. Since the clamp tool 19" is at right angles to the chord 20C, load applied by the chords against the clamp head 260 is in the direction of ram arm 262 and therefore does not tend to rotate the clamp 19" on pin 257. The clamp tool 19" is of known design except of the inclusion of a hole through which the pin 257 can pass to secure the clamp tool 19' to the top plate 102 of the carriage 100.

It should be understood that in some embodiments of the invention, the carriage 100 is made up of the carriage guide 120 and the top plate 102. In other embodiments, the top plate 102 is effectively incorporated into the tool (such as the plate 250 which forms part of the apex tool 19') and therefore the carriage is effectively comprised of the carriage guide 120 and the tool defines the top plate (such as plate 250) and blocks (such as blocks 110') connected to the plate 250 which slide on the steps 106 and 108 on the guide rail.

Figure 8:
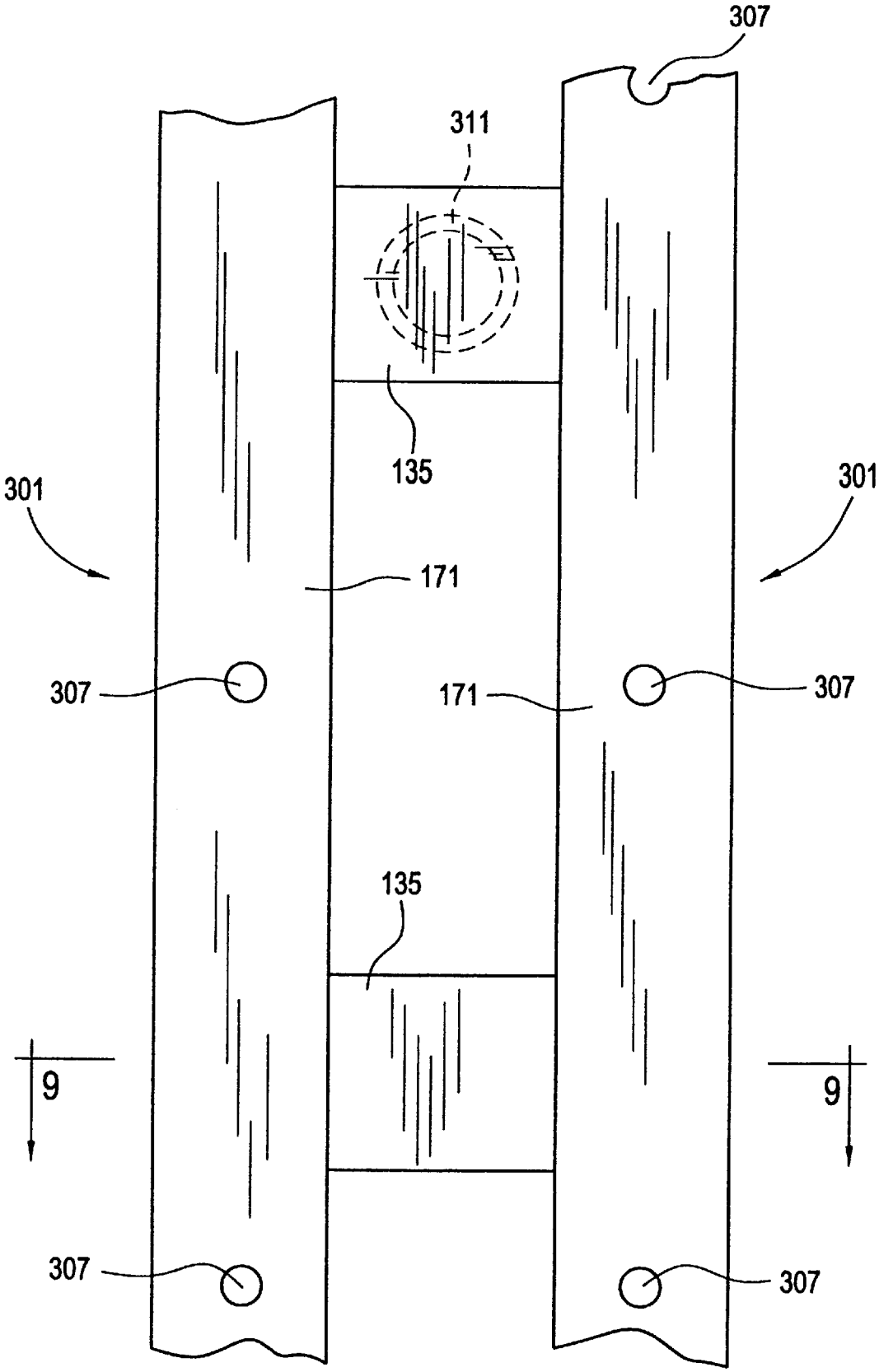
FIG. 8 is a fragmentary plan view of a guide rail of the preferred embodiment of the invention.
Figure 9:
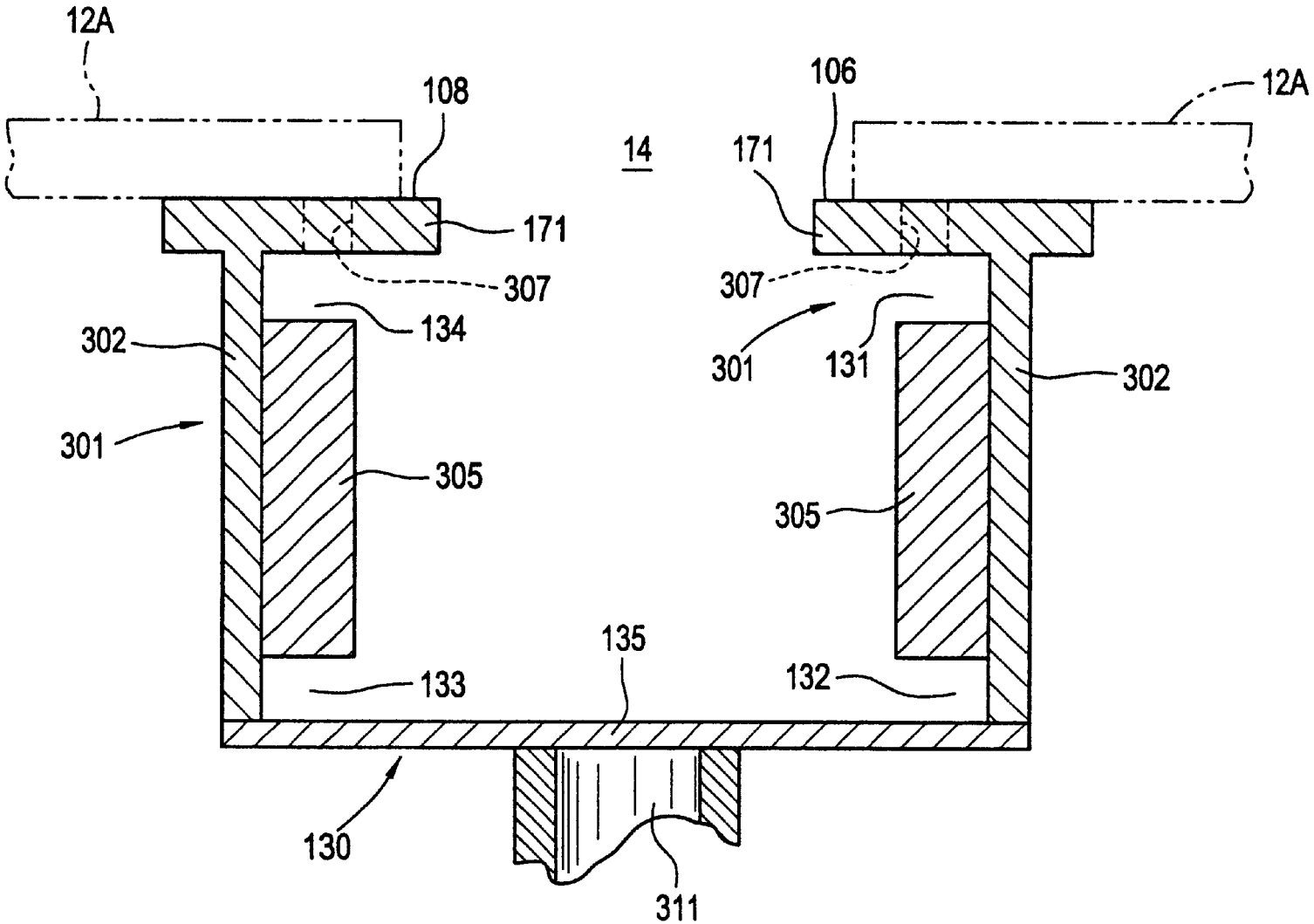
FIG. 9 is a section taken as indicated by line 9—9 of FIG. 8.

FIGS. 8 and 9 illustrate in more detail the configuration of the guide rail 130. As best shown in FIGS. 8 and 9, the guide rail 130 is formed from two inverted L-shaped rail members 301 which are arranged in face to face or mirror image relationship with respect to one another. The rail members 301 have the inwardly projecting flange portions 171 which, together with the sections 12A define the steps 106 and 108 upon which the top plate 102 or the base plate 250 of the apex tool 19' ride. The flange portions 171 are supported by side walls 302. The side walls 302 are coupled together by a plurality of lower plates 135 which are welded to lower edges of the side walls at locations spaced along the length of the guide rail 130. The flanges 171 also each have spaced apart holes 307 which facilitate bolting of the sections 12A of the platform 12 to the flanges.

Elongate bars 305 are welded to the inner surfaces of the side walls 302 of the guide rail 130 so as to define the channels 131, 132, 133 and 134. Some of the plates 135 carry sleeves 311 so that jacks or other suitable supporting structure (not shown) can be engaged with the sleeves to support the guide rails 130 above ground level. I-beams (not shown) may be provided between adjacent guide rails 130 for supporting mid portions of the sections 12A. The I-beams are attached to a conventional frame of the table 10. Thus, the sections 12A of the upper platform 12 are supported by the guide rails 130 as well as additional frame members formed at least partly by the I-beams (not shown).

A jig tool 19, 19' or 19" may be secured to the top plate 102 and carriage 120 which covers substantially the entire plate 102. If the support of the chord 20B at that particular top plate 102 is not required, the spring plate 152 can simply be lifted up slightly so as to raise the flange 153 above the top surface of the sections 12A and then the plate 152 can be rotated about the pin 140 into a position 180° from that shown in FIGS. 2 and 3 to move the spring plate 152 into a non-operative position and out of any interference with the tool to be supported on the top plate 102. For example, the spring plate 152 could be moved into the non-operative position as shown in phantom in FIG. 7 so that the central portion 155 does not interfere with correct positioning of the clamp tool 19" relative to the top plate 102 and the chord 20C. This enables the spring plate 152 to be moved out of the way while retaining the spring plate on the apparatus for convenient repositioning should the respective carriage 102 again be required to support one of the chords 20A–20C above the platform 12. Retention of the spring plate 152 on the carriage 100 also prevents misplacement of the spring plates or accidental loss of the spring plates when they are not in use.

Figure 10:
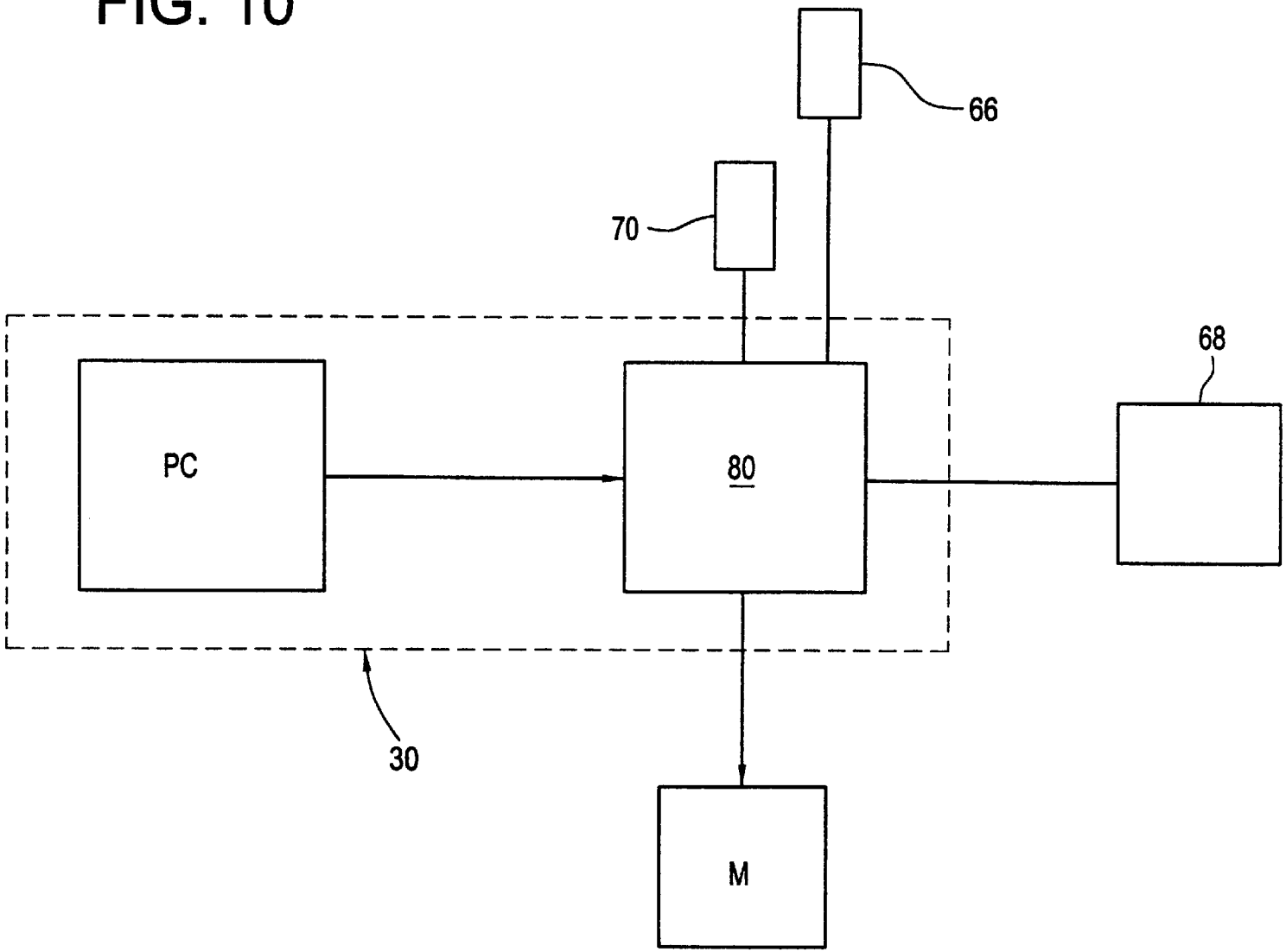
FIG. 10 is a schematic view of a control system for controlling the jigging system of FIGS. 1 to 9.
Figure 10A:
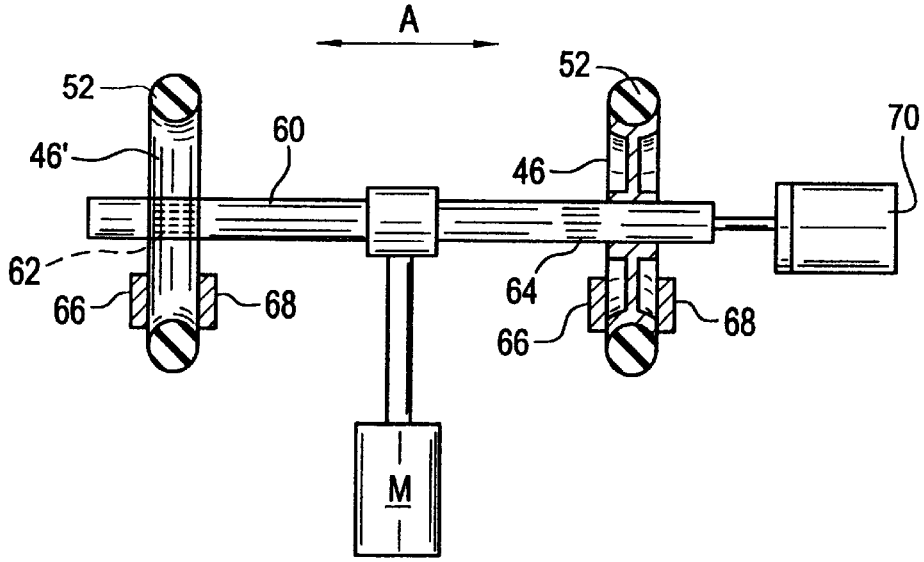
FIG. 10A is a diagram illustrating how a carriage is moved along the table according to one embodiment of the invention.

FIGS. 10 and 10A schematically illustrate the control system 30 for controlling the jig. The control system 30 includes a portable computer PC which is coupled to a controller 80. The controller 80 is then in turn coupled to motor M, encoder 68 and also controls solenoid 70 and disc brakes 66. One controller 80 can be used to control, for example, six pucks 19, six other jig tools (e.g., 19', 19"), or some combination of pucks and other tools. In the instance where the table 10 has forty-two tools (including pucks 19), seven controllers 80 connected to the PC for controlling the jig are used. The controller 80 which controls each set of six tools (19, 19' or 19") will also control the associated motor M, encoder 68, brakes 66 and solenoid 70 associated with those tools.

Each of the controllers 80 therefore is controlling six of the tools (19, 19' or 19"). The controller 80 obtains information identifying the position of each of the tools which it is to control. The information is fed to the controller 80 from the encoder 68 on the pulleys 46. It should also be noted that all of the tools could be under the control of a single controller 80 rather than a number of controllers and all driven simultaneously to their desired positions under the command of the controller 80. Conceivably, a greater number of controllers could be employed.

In the preferred embodiment, information relating to a truss layout is fed into the PC and that information is then provided to the controller 80. Initially, the tools 19, 19', 19" are moved to a zero position by the controller 80. The controller 80 selects one of the tools, e.g., one of the pucks 19, and knowing the position of the puck 19, it will compare the required position to the actual position of the puck. A command is issued from the controller 80 to the brake 66 associated with the relevant puck 19 so that the brake is released. An output is supplied to solenoid 70 to ensure that the shaft 60 is moved axially into the position so that the spline 62 or 64 engages the appropriate pulley 46 and a voltage is supplied to the motor M to drive the shaft 60 at high speed. The shaft 60 rotates the pulley 46 to drive the appropriate belt 52 about the pulleys 46 and 48 to move the carriage 100 to the desired position to correctly position the puck 19.

When the puck 19 comes to within a specified distance from its required position (which may be indicated by a number of counts issued from encoder 68) the motor speed is switched to low speed by the controller 80. Typically this will occur after one or two seconds of running. Again, when the puck 19 is within the specific number of counts of the actual position required, the controller 80 issues a signal to disc brake 66 to apply the brake to stop the pulley 46 so that the tool 19 comes to rest at the required position. The motor M is then switched off. The specific number of counts at which the motor is reduced to low speed and at which the brake is applied can be determined by the system response time and could be adjustable and preset in the controller 80. The controller then selects another tool (19, 19' or 19") so that the next tool can be moved. The solenoid 79 is operated to disengage splines 62 of the shaft 60 from the pulley 46 and to engage the other spline 64 with its pulley 46'. The same procedure as outlined above is then repeated to position the other tools.

For any truss configuration only some of the tools 19, 19', 19" which may be provided may be used. Those tools which need not be used for a particular truss configuration can be controlled so that they are moved to the edge of the table so that they are completely out of the way of the truss 20 which is to be manufactured.

In the preferred embodiment of the invention, the pucks 19 are coupled to top plates 102 and carriages 120 by a pin 140 so that the pucks 19 can be released from any of the respective carriages in a similar fashion to the tools 19', 19". The tools 19, 19', 19" are released from their carriage guides 120 by simply prying the pin 140 upward from the sleeve 125 by means of a screwdriver or any other suitable tool. The upward motion of the pin 140 overcomes the spring force of the circlip 142 and drives the circlip out of the groove 149 and into the space 144 so the pin can be withdrawn from the sleeve 125. The easy removal and replacement of the jig tools 19, 19' or 19" enables a particular jig tool to be associated with any one of the carriages 100 associated with any one of the slots 14.

The processor PC will determine at which of the slots 14 the apex 21 of the truss is to be located and will show this either graphically, numerically or otherwise on a display screen. If an apex tool 19' is not already associated with the slot 14, the apex tool associated with one of the other slots 14 can be removed by releasing the pin 140 as described above and the apex tool snapped into connection with the carriage 100 associated with the appropriate slot 14. Similarly, other tools such as clamp tool 19" and pucks 19 can be released from particular carriages 100 and connected to other carriages 100 under the direction of the PC. The PC then controls the carriages 100 as described above to position the tools 19, 19' and 19" in the required position for enabling the chords 20A–20C (and web 20D in the embodiment shown in FIG. 1) to be located and fastened together by the connector plates previously described.

FIGS. 11 to 14 show a further embodiment of the invention in which a heel tool for locating the heel position of a truss is shown. The heel tool 400 is not movable along the channels 14 as is the case with the tools 19, 19', 19" previously described but is fixed in position to the table 10 by pairs of holes 401 and 402 which are provided on some or all of the sections 12A of the upper platform 12. In the embodiment shown in FIG. 11, two rows (labeled C and D) of holes 401 and 402 are shown. The heel tool 400 is fixed to one of the hole pairs 401 and 402 in row C on the section 12A' shown in FIG. 11. The holes 401, 402 are covered by the tool 400 in FIG. 11.

Figure 12:
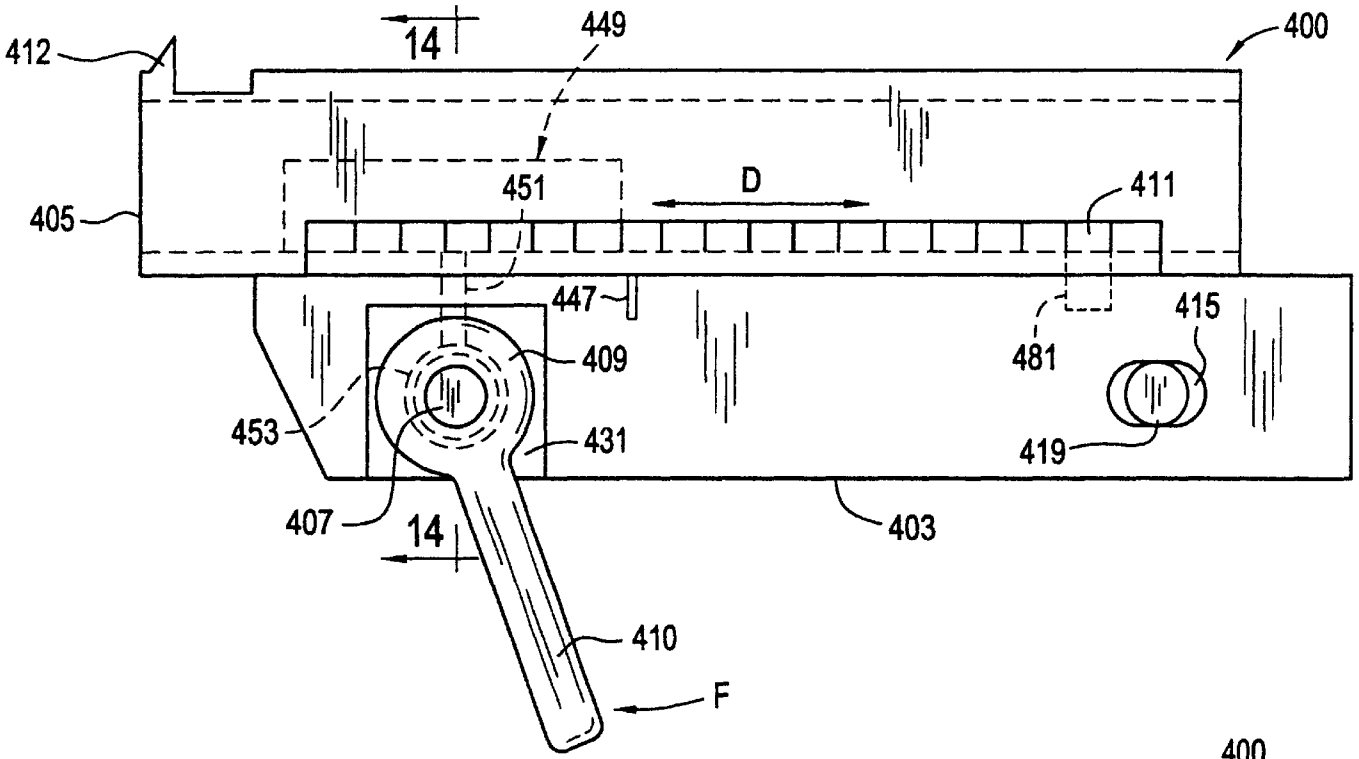
FIG. 12 is an enlarged top plan view of the heel tool.
Figure 13:
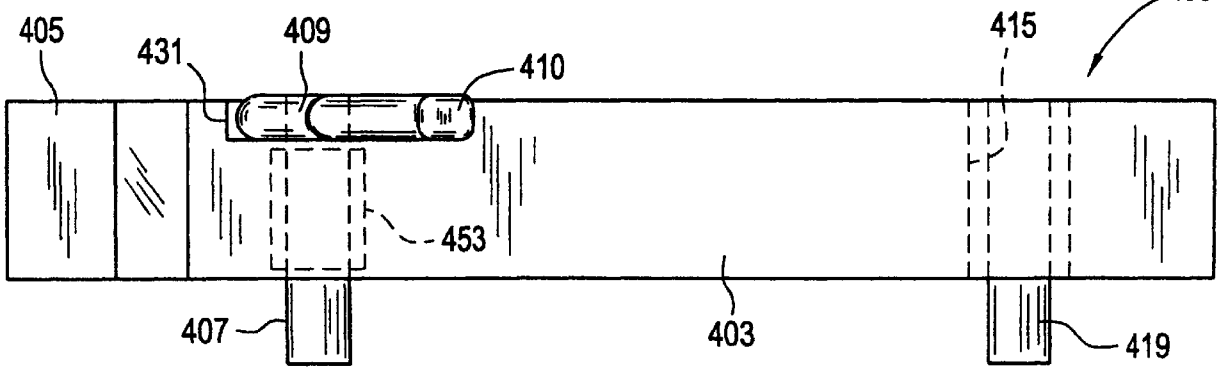
FIG. 13 is a side view of the heel tool.

The tool 400 has a base section 403 and a heel point section 405 which is moveable relative to the base section 403. As best shown in FIG. 12 which shows the tool more enlarged (and in a more retracted position than in FIG. 11) the base 403 has a recess 431 in which is located a head 409 arranged on a pin 407, which pin is located in the hole 401 shown in FIG. 11. The base 403 also carries an elongate hole 415 which carries a floating pin 419 for location in the hole 402 in the section 12A' shown in FIG. 11. The pins 407 and 419, as well as the holes 401 and 402 are preferably configured similar to the pin 140 and sleeve 125 previously described for secure releasable connection. The floating pin 419 in the elongated groove 415 provides some degree of movement of the pins 407 and 419 relative to one another to ensure that they can properly locate in the precision drilled holes 401 and 402. The ability to locate the tool 400 on the assembly table 20 and then simply move the heel point section a short distance to define the heel point location enables quick and accurate determination of the heel point location and positioning the tool 400.

When the truss. 20 is being formed, the PC will identify the heel point location for the truss 20 which is to be formed and will then display the holes 401 and 402 to which the heel tool 400 should be attached. The PC will then indicate the amount of movement of the heel point section 405 relative to the base 403 which is required in order to position a heel point locating tab 412 on the tool 400 at the desired point to identify the heel location of the truss 20. The section 405 carries a scale 411, and the base 403 a pointer 447. Thus, the computer can indicate a value on the scale 411 which should be aligned with the pointer 447 to locate the heel point section 405 in the desired position relative to the base 403 for positioning the heel point locating tab 412 at the required place on the assembly table 400.

Figure 14:
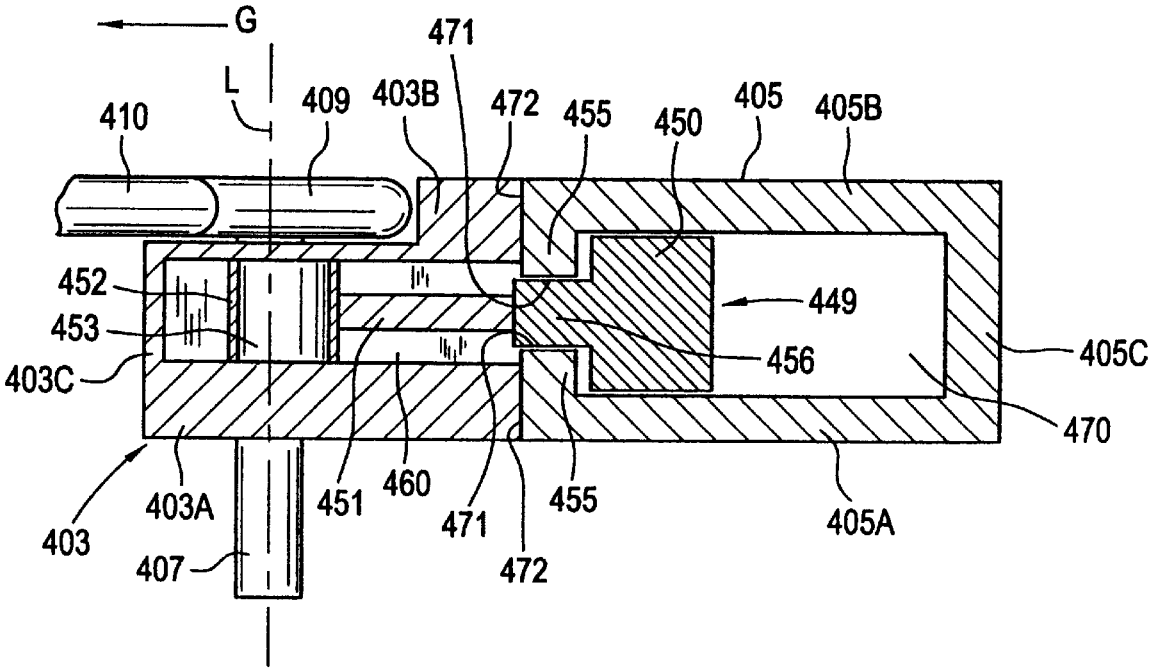
FIG. 14 is a section taken in the plane including line 14—14 of the heel tool of FIG. 12.
Figure 11:
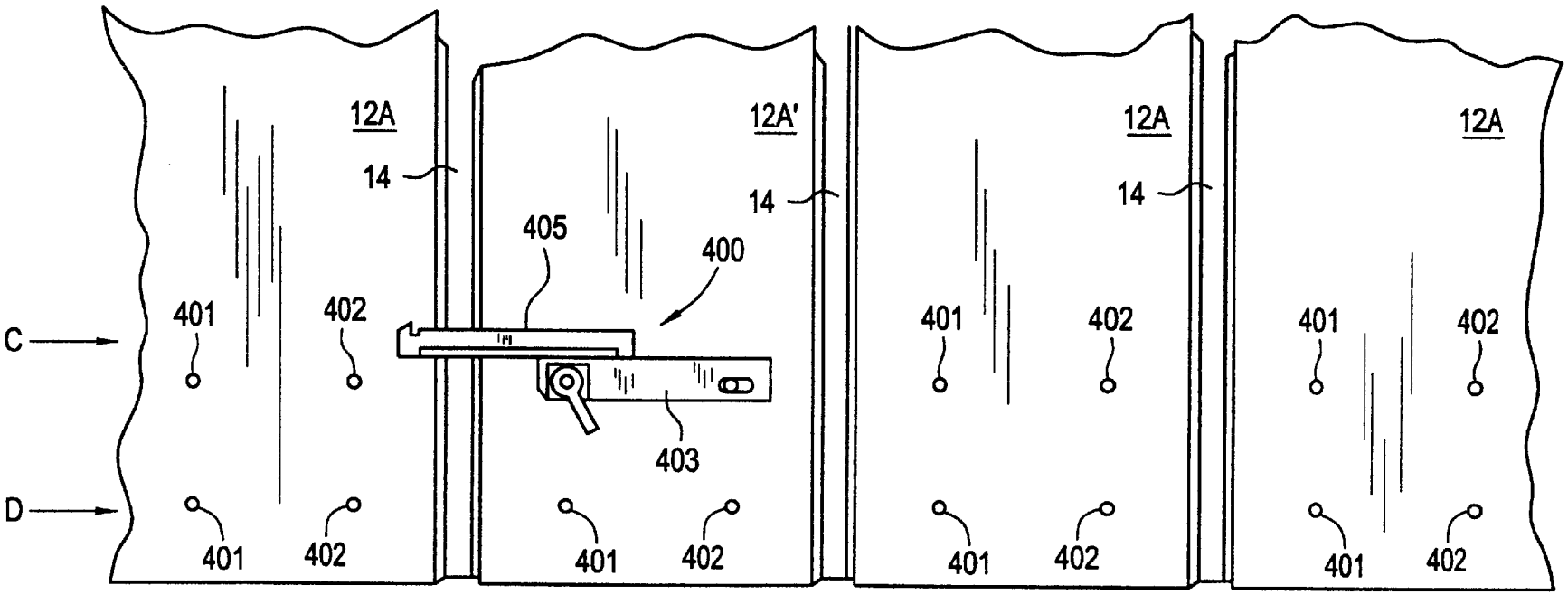
FIG. 11 is a fragmentary plan view of part of the table showing a heel tool according to a further embodiment of the invention.

As is best shown in the cross-sectional view of FIG. 14, the heel point section 405 is formed from a generally C-shaped channel having bottom wall 405A, end wall 405C and top wall 405B. A pair of inwardly directing flanges 455 and 456 define a narrow slot 471 in the heel point section 405. The base 403 is formed of a generally C-shaped channel having a bottom wall 403A, a top wall 403B and end wall 403C. The walls 403A and 403B have free ends 472 which face and generally abut the flanges 455 and 456. The walls 403A and 403B define an open space 460 therebetween and the walls 405A and 405B define a cavity 470 therebetween.

A locking bar 449 is accommodated in the cavity 470 of the heel point section 405 and has an enlarged head 450 and a stem 456 which projects through the channel 471 between the flanges 472. A bar 451 is coupled to the stem 456 and projects into the space 460. Pin 407 carries an integral eccentric 453. A sleeve 452 is provided about the eccentric so that the pin and eccentric can rotate about the axis L of the pin relative to the sleeve. The bar 451 is welded to the sleeve 452 which holds the sleeve against rotation with the eccentric 453.

In order to lock the heel point section 405 to the base 403 so that the heel point section cannot move relative to the base 403, a handle 410 mounted on top of the pin 407 is rotated in the direction of arrow F (FIG. 12) so the pin rotates about its longitudinal axis L (FIG. 14) in hole 401. This rotation causes the eccentric 453 to rotate with the pin 407 and the rotation of the eccentric 453 causes the sleeve 452 to move in the direction of arrow G in FIG. 14 within the space 460 to pull the bar 451 and also the head 450 in the same direction so that the head securely clamps the flanges 455 against the free ends 472 of the walls 403A and 403B. Thus, the heel point section 405 is securely clamped against the base 403 so it cannot move. In order to release the heel point section 405 for movement relative to the base 403 either direction of double headed arrow D in FIG. 12, the handle 410 is rotated in the opposite direction to arrow F (back, for example, to the position shown in FIG. 12) so as to rotate the eccentric 453 to move the sleeve 452 in a direction opposite arrow G in FIG. 14. This causes the clamping pressure supplied by the head 450 which pushes the flanges 455 hard against the free ends 472 to be released. The heel point section 405 can then slide in the direction of arrow D relative to both the locking bar 449 and also the base 403 with the flanges 455 sliding on the free ends 472 of the walls 403A and 403B. To prevent rotation of the heel point section 405 about bar 451, relative to the base 403 into and out of the plane of the paper of FIG. 12, which may be allowed by any tolerance provided for the sleeve 452 and eccentric 453 within the space 460, a tongue 481 is provided on the heel point section 405 which projects into the space 460 between the walls 403A and 403B.

According to the preferred embodiment of the invention, the jig system can be automatically set up to receive components of a truss and the truss can be easily manipulated to enable connector plates to be inserted in place for formation of the truss. Thus, not only is set up of the jig quickly effected, but formation of the truss is also more easily and quickly performed.

Since modifications with the spirit and scope of the invention may readily effected by persons of ordinary skill in the art, it is to be understood that this invention is not limited to the particular embodiment described by way of example hereinabove.

What is claimed is:

1. A jigging system for use in arranging components to form an assembly such as a truss, the jigging system comprising:

an upper platform having spaced apart slots therein;

at least one tool carriage mounted in one of said slots for sliding movement relative to the upper platform along said one slot; and a tool adapted for connection to said one carriage for movement with said one carriage along the slot, the tool adapted for locating at least one of said components with respect to the upper platform;

the tool and carriage being constructed for releasable, snap-in connection of the tool in the carriage so that said one carriage is for carrying multiple tools.

2. The jigging system as set forth in claim 1 further comprising a plurality of tools constructed for releasable, snap-in connection to said one carriage.

3. The jigging system as set forth in claim 1 wherein the tool is constructed for non-rotational movement into connection with the carriage and for non-rotational movement out of connection with the carriage.

4. The jigging system as set forth in claim 1 further comprising a resilient locking member adapted for releasable snap locking interengagement of the tool and the carriage.

5. The jigging system as set forth in claim 4 wherein the carriage comprises an opening, the resilient locking member being held in the opening, and wherein the tool comprises a pin receivable in the opening, the pin having a groove therein for receiving the locking member therein for holding the pin in the opening.

6. The jigging system as set forth in claim 5 wherein the resilient lock member comprises a split ring retainer having an internal diameter less than a diameter of the pin.

7. The jigging system as set forth in claim 6 wherein the tool is selected from a group including: a stop, an apex tool and a clamp tool.

8. The jigging system as set forth in claim 6 wherein the carriage further comprises an upper bushing and a lower bushing, the upper and lower bushings being disposed in the opening and separated from each other to define a space, apart the split ring retainer being disposed in the space between the upper and lower bushings.

9. The jigging system as set forth in claim 1 further comprising a resilient component support mounted by the tool on the carriage, the component support in a relaxed configuration extending upwardly above the level of a top surface of the upper platform for holding components above the upper platform, the component support being resiliently deformable upon application of a downward force to the component to permit the component to engage the top surface of the upper platform.

10. The jigging system as set forth in claim 9 wherein the component support is formed from a single piece of metal formed into a generally inverted channel shape.

11. The jigging system as set forth in claim 1 further comprising a drive for driving movement of said one carriage in the slot.

12. The jigging system as set forth in claim 1 further comprising a heel locating device including a first section adapted for connection to the upper platform, a second section slidably mounted on the first section for extension and retraction relative to the first section, the second section having an end constructed for locating a heel of a truss, a locking device for locking the first and second sections in a fixed position relative to each other, and a scale associated with one of the first and second sections for locating the second section relative to the first section.

13. A The jigging system as set forth in claim 12 wherein the heel locating device further comprises pins connected to the first section and wherein the upper platform has holes therein arranged for receiving the pins to secure the heel locating device to the upper platform.

14. A jigging system for use in arranging components to form an assembly such as a truss, the jigging system comprising:

an upper platform having a top surface and spaced apart slots therein;

at least one carriage mounted in one of said slots for sliding movement relative to the upper platform along said one slot; and a component support for supporting the components in a position above the top surface of the upper platform, the component support being connected to the carriage and comprising a first portion engaging the carriage and a second portion spaced above the carriage and engageable with one of the components, the second portion being adapted to resiliently deform upon application of downward force to the component to permit the component to engage the top surface of the upper platform, and to return to an original configuration upon release of the downward force.

15. The jigging system as set forth in claim 14 wherein the component support includes a third portion disposed on an opposite end of the component support from the first portion, the third portion engaging the carriage.

16. The jigging system as set forth in claim 15 wherein the second portion of the component support has a generally inverted channel shape.

17. The jigging system as set forth in claim 16 wherein the first portion of the component support is attached to the carriage and the second and third portions are free of connection to the carriage.

18. The jigging system as set forth in claim 17 further comprising a tool for locating at least one of the components on the upper platform, the tool mounting itself and the component support on the carriage.

19. The jigging system as set forth in claim 18 wherein the tool and carriage are adapted for releasable snap locking interengagement.

20. The jigging system as set forth in claim 14 further comprising a drive for driving movement of said one carriage in the slot.

21. The jigging system as set forth in claim 14 further comprising a heel locating device including a first section adapted for connection to the upper platform, a second section slidably mounted on the first section for extension and retraction relative to the first section, the second section having an end constructed for locating a heel of a truss, a locking device for locking the first and second sections in a fixed position relative to each other, and a scale associated with one of the first and second sections for locating the second section relative to the first section.

22. A jigging system for use in arranging components to form an assembly such as a truss, the jigging system comprising:

an upper platform having a top surface and locating holes in the top surface; and a heel locating device including a first section having pins receivable in the locating holes for connecting the heel locating device to the upper platform, a second section slidably mounted on the first section for extension and retraction relative to the first section, the second section having an end constructed for locating a heel of a truss, a locking device for locking the first and second sections in a fixed position relative to each other, and a scale associated with one of the first and second sections for locating the second section relative to the first section.

23. The jigging system as set forth in claim 22 wherein the locking device of the heel locating device comprises a lever, an eccentric mounted for pivoting with the lever, and a clamp moveable upon turning the lever to clamp the first and second sections together in a fixed position.

24. The jigging system as set forth in claim 23 wherein the upper platform has slots therein, and wherein the system further comprises at least one carriage mounted in one of said slots for sliding movement relative to the upper platform along said one slot.

25. The jigging system as set forth in claim 24 further comprising a tool for locating components on the upper platform, the tool being adapted for releasable, snap locking engagement with the carriage.

26. The jigging system as set forth in claim 24 further comprising a component support for supporting the components in a position above the top surface of the upper platform, the component support being connected to the carriage and comprising a first portion engaging the carriage and a second portion spaced above the carriage and engageable with one of the components, the second portion being adapted to resiliently deform upon application of downward force to the component to permit the component to engage the top surface of the upper platform, and to return to an original configuration upon release of the downward force.

* * * * *

UNITED STATES PATENT AND TRADEMARK OFFICE

CERTIFICATE OF CORRECTION

PATENT NO. : 6,702,269 B1
DATED : March 9, 2004
INVENTOR(S) : John Tadich

It is certified that error appears in the above-identified patent and that said Letters Patent is hereby corrected as shown below:

Column 9,
Lines 42-43, “tool adapted for” should read -- tool for --.

Column 10,
Line 35, “A The jigging” should read -- The jigging --

Signed and Sealed this

First Day of June, 2004

JON W. DUDAS
*Acting Director of the United States Patent and Trademark Office*